United States Patent [19]

Hargabus

[11] Patent Number: 4,761,004

[45] Date of Patent: Aug. 2, 1988

[54] INFINITY MIRROR DISPLAY

[76] Inventor: Patrick A. Hargabus, 1709 Pattison Ave., Sarasota, Fla. 33579

[21] Appl. No.: 883,342

[22] Filed: Jul. 8, 1986

[51] Int. Cl.[4] ..... A63G 5/00

[52] U.S. Cl. ..... 272/13; 272/8.5

[58] Field of Search ..... 272/8.5, 13; 40/219; 350/602; 362/61, 64

[56] References Cited

U.S. PATENT DOCUMENTS

| | | | |
|---|---|---|---|
| 1,750,994 | 3/1927 | Dorman | 362/64 |
| 2,056,383 | 6/1934 | Benway | 40/219 |
| 2,114,711 | 8/1937 | Horinstein | 40/219 |
| 2,132,472 | 7/1937 | Holm | 272/13 |
| 2,188,677 | 9/1938 | Dickinson | 362/61 |
| 2,286,246 | 10/1940 | Yearta | 40/219 |
| 2,286,247 | 5/1941 | Yearta | 272/13 |
| 2,579,230 | 4/1949 | Giboney | 362/61 |
| 4,139,955 | 2/1979 | Reiback | 40/427 |
| 4,417,411 | 11/1983 | Miyagishima et al. | 40/219 |
| 4,498,124 | 2/1985 | Mayer et al. | 362/61 |

*Primary Examiner*—Robert A. Hafer
*Assistant Examiner*—Michael Brown
*Attorney, Agent, or Firm*—Charles J. Prescott; Raymond H. Quist

[57] ABSTRACT

An infinity mirror display is disclosed in which light is introduced between the totally reflecting mirror and the partially reflecting mirror by holes through the totally reflecting mirror. This light may be incandescent bulbs extending through the holes or fiber optics conveying light through the holes from a light source behind the totally reflecting mirror. It is preferred that the light source extend to the partially reflecting mirror to produce images which appear to be a continuous column which diminishes in size and intensity.

12 Claims, 1 Drawing Sheet

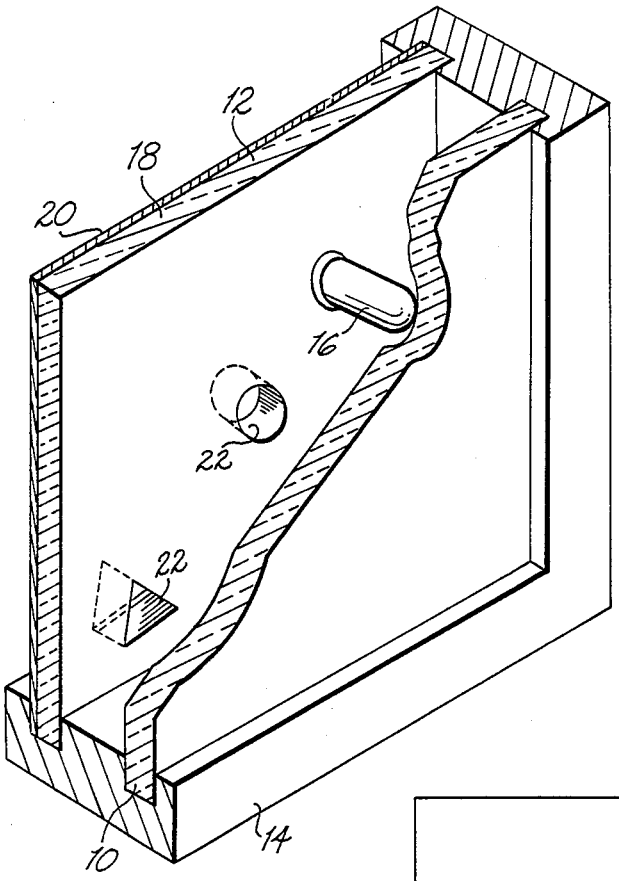
Fig. 1
Fig. 2
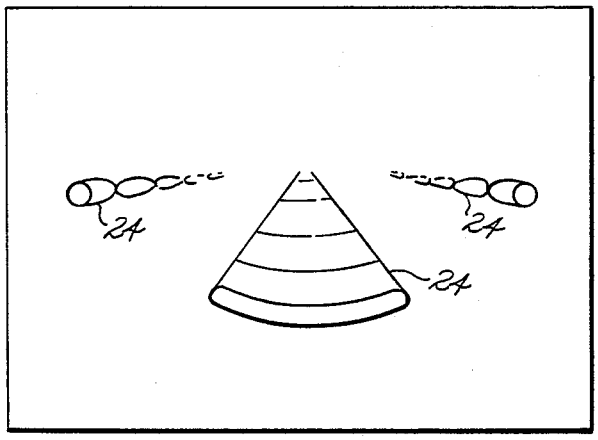
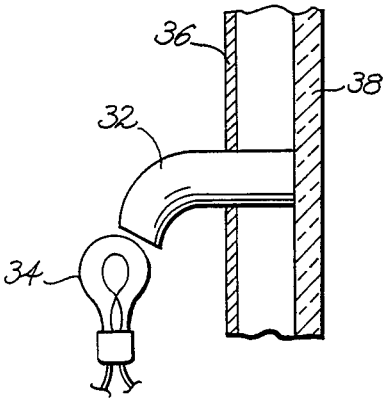
Fig. 4
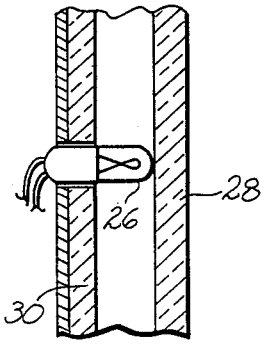
Fig. 3

INFINITY MIRROR DISPLAY

BACKGROUND OF THE INVENTION

1. Field of the Invention

This invention relates generally to an infinity mirror display, and more particularly to such a device which provides a greater range of display effects.

2. Description of Related Art

The infinity mirror effect is perhaps most commonly observed in rooms having mirrors on oppositely facing walls. The mirrors show images of the same object repeated apparently endlessly, but with each new image somewhat smaller and appearing farther away. In this arrangement the observer is between the opposed mirrors. It is possible to produce a somewhat similar series of diminishing images by locating a partially transparent mirror in front of a fully reflecting mirror and placing an object or light source between the mirrors.

U.S. Pat. No. 2,286,247, Yearta, entitled "Display Device", discloses a transparent mirror spaced from an opaque mirror with an object placed between the mirrors illuminated by a light bulb.

U.S. Pat. No. 4,139,955, Reiback, entitled "Display Device", shows a similar arrangement having multiple light bulbs in the space between the mirrors arranged around the edge of the viewing area. An alternate embodiment discloses removing a portion of the silvering of the opaque mirror and providing illumination behind this mirror which will pass through the unsilvered area and produce multiple, diminishing images.

Concomitantly with the diminishing sizes of the successive images is a diminishing intensity, caused by various light losses such as in passing through the partially transparent mirror.

It is therefore an object of this invention to provide an infinity mirror display having one or more light sources at any desired location within the viewing area of the display.

It is also an object of this invention to provide an infinity mirror display in which the orientation of the light sources causes the successive images to appear as continuous light lines or columns.

In accordance with these and other objects, which will become apparent hereafter, the instant invention will now be described with reference to the accompanying drawings.

BRIEF DESCRIPTION OF THE DRAWINGS

FIG. 1 is an isometric showing a portion of an infinity mirror display device in accordance with the invention;

FIG. 2 is an elevation representing the appearance of a pattern formed in accordance with the invention;

FIG. 3 is a cross-section illustrating one way of providing light in accordance with the invention; and FIG. 4 is a cross-section illustrating an alternative way of providing light in accordance with the invention.

SUMMARY OF THE INVENTION

A partially transparent, or two-way mirror is positioned in front of and spaced from a fully reflecting mirror. Holes passing through the fully reflecting mirror from its rear surface to its front surface provide a passage for light. This light may originate behind the fully reflecting mirror and be passed through the passage as light rays, or conveyed through the passage using fiber optics, or be a light source such as an incandescent bulb positioned in or through the passage. In the preferred embodiment the light source will extend to the partially reflecting mirror so that the successive diminishing images appear as a continuous column.

DETAILED DESCRIPTION OF THE INVENTION

Referring to FIG. 1, a portion of an infinity mirror diaplay is shown to illustrate the basic arrangement of the invention. A first mirror 10 is held in spaced relationship to a second mirror 12 by mounting means such as frame 14. First mirror 10 is a partially reflecting type also called a two-way mirror. With first mirror 10 adjacent to an observer, mirror 10 will appear to be fully reflecting. If, however, a light source such as incandescent light bulb 16 is illuminated between first mirror 10 and second mirror 12, the observer will see light bulb 16 (or at least the light therefrom).

Because second mirror 12 is located behind first mirror 10, the observer will also see the image of light bulb 16 which is reflected from second mirror 12. Moreover, another image of light bulb 16 is reflected from first mirror 10 to second mirror 12 and then back to the observer. Each successive image diminishes in size and intensity and so appears farther away and less bright.

Second mirror 12 is preferably a fully reflecting mirror which may be a glass pane 18 having a reflecting surface 20, such as the conventional silvered mirror. In accordance with the invention, holes 22 pass through second mirror 12. Holes 22 may be of any desired size and shape so as to admit light from a source located behind second mirror 12, or to admit a light source such as incandescent bulb 16.

Referring to FIG. 2, it will be observed that the successive images appear to form columns 24 of diminishing size and intensity, rather than discrete, separate images. As shown in FIG. 3, by letting the light source, such as bulb 26, extend to touch first mirror 28, this continuous column effect is achieved. If, instead, bulb 26 were positioned intermediate first mirror 28 and second mirror 30, discrete, separate images would result.

As shown in FIG. 4, a light conveying conduit 32, which may be a single transparent plastic element having a desired cross-section, or a bundle of transparent fibers, may be used to convey light from a source 34 located behind second mirror 36, through second mirror 36 and extending to first mirror 38. Second mirror 36 may be another type of fully reflecting mirror such as a polished metal sheet.

It will be apparent that either the first or second mirror or both need not be planar, so as to vary the display. Also, various patterns and shapes of holes can be used to achieve both visually pleasing and functional results, e.g. indicia for a clock face. Although it is possible to achieve the beneficial results of the invention merely by positioning a light source behind the second or fully reflecting mirror so that light will shine through the hole(s), it should be recognized that the portion of the light which passes through the first or partially reflecting mirror is not available in producing the reflected images. Consequently, having a more intense light source between the mirrors results in a more pronounced visual effect.

While the instant invention has been shown and described herein in what is conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. An infinity mirror display comprising:

a frame having a front opening defining a viewing area;

first and second mirrors;

said first mirror being partially reflecting and mounted in said frame adjacent to said front opening and displayed in said viewing area;

said second mirror having a fully reflecting surface on one side and mounted in said frame further removed from said front opening than said first mirror with said fully reflecting surface spaced from said first mirror; and said second mirror having at least one illuminating hole passing through it.

2. An infinity mirror display in accordance with claim 1 wherein:

said light source extends from said hole to said first mirror.

3. An infinity mirror display in accordance with claim 1 wherein:

said first and second mirrors are coextensive.

4. An infinity mirror display in accordance with claim 1 wherein:

said first and second mirrors are planar and parallel to each other.

5. An infinity mirror display in accordance with claim 1 further including:

a light conveying conduit positioned in said illuminating hole.

6. An infinity mirror display in accordance with claim 5 wherein:

said light source is an incandescent bulb.

7. An infinity mirror display comprising:

a frame having a front opening defining a viewing area;

first and second planar mirrors;

said first mirror being partially reflecting and mounted in said frame adjacent to said front opening and displayed in said viewing area;

said second mirror having a fully reflecting surface on one side and mounted in said frame further removed from said front opening than said first mirror with said fully reflecting surface spaced from and parallel to said first mirror; and said second mirror having at least one illuminating hole passing through it.

8. An infinity mirror display in accordance with claim 7 further including:

a light conveying conduit positioned in said illuminating hole.

9. An infinity mirror display in accordance with claim 7 further including:

a light source positioned in said illuminating hole.

10. An infinity mirror display in accordance with claim 9 wherein:

said first and second mirrors are coextensive.

11. An infinity mirror display in accordance with claim 9 wherein:

said light source extends from said hole to said first mirror.

12. An infinity mirror display in accordance with claim 9 wherein:

said light source is an incandescent bulb.

* * * * *